US011684229B2

(12) United States Patent
Lu

(10) Patent No.: US 11,684,229 B2
(45) Date of Patent: Jun. 27, 2023

(54) MOBILE ROBOT

(71) Applicant: SHENZHEN SILVER STAR INTELLIGENT GROUP CO., LTD., Guangdong (CN)

(72) Inventor: Quanlong Lu, Guangdong (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 754 days.

(21) Appl. No.: 16/631,391

(22) PCT Filed: Dec. 12, 2017

(86) PCT No.: PCT/CN2017/115640
§ 371 (c)(1),
(2) Date: Jan. 15, 2020

(87) PCT Pub. No.: WO2019/024376
PCT Pub. Date: Feb. 7, 2019

(65) Prior Publication Data

US 2020/0214525 A1 Jul. 9, 2020

(30) Foreign Application Priority Data

Aug. 3, 2017 (CN) ..... 201710654174.3

(51) Int. Cl.
*A47L 11/40* (2006.01)
*A47L 11/24* (2006.01)

(52) U.S. Cl.
CPC ..... *A47L 11/4041* (2013.01); *A47L 11/24* (2013.01); *A47L 11/4008* (2013.01);
(Continued)

(58) Field of Classification Search
CPC .. A47L 11/24; A47L 11/4013; A47L 11/4025; A47L 11/4041; A47L 11/4072; A47L 2201/00; A47L 11/4083
See application file for complete search history.

(56) References Cited

U.S. PATENT DOCUMENTS

2014/0182627 A1 7/2014 Williams et al.

FOREIGN PATENT DOCUMENTS

CN 102217914 A 10/2011
CN 103027633 A 4/2013
(Continued)

OTHER PUBLICATIONS

International Search Report for the International Application No. PCT/CN2017/115640 (dated May 2, 2018), 8 pages.
(Continued)

*Primary Examiner* — Randall E Chin
(74) *Attorney, Agent, or Firm* — Yu Gang

(57) ABSTRACT

A mobile robot. The mobile robot comprises a robot housing (10), two moving components (40), a container apparatus (20), and a cleaning component (50); the moving components are mounted on the robot housing for moving the mobile robot; the cleaning component comprises a main brush (520) provided laterally relative to a normal forward direction (f) of the mobile robot; the main brush is mounted on the robot housing and at or near a part of the robot housing, at which position a transverse width is largest; extension of the main brush in a direction perpendicular to the normal forward direction of the mobile robot is not interfered with by the moving components. The mobile robot has a larger main brush width, and thus the working width of the mobile robot is increased.

15 Claims, 10 Drawing Sheets

(52) U.S. Cl.
CPC ..... *A47L 11/4013* (2013.01); *A47L 11/4025* (2013.01); *A47L 11/4072* (2013.01); *A47L 2201/00* (2013.01)

(56) References Cited

FOREIGN PATENT DOCUMENTS

| | | | |
|---|---|---|---|
| CN | 205006814 | A | 2/2016 |
| CN | 206285036 | U | 6/2017 |
| CN | 206285064 | U | 6/2017 |
| CN | 206285065 | U | 6/2017 |
| CN | 107253205 | A | 10/2017 |
| CN | 107307798 | A | 11/2017 |
| CN | 207077444 | U | 3/2018 |
| CN | 207206437 | A | 4/2018 |
| DE | 10 2011 000 816 | A1 * | 8/2012 |
| JP | H0663883 | A | 3/1994 |

OTHER PUBLICATIONS

Written Opinion of International Search Authority for the International Application No. PCT/CN2017/115640 (dated May 2, 2018), 4 pages.
Search report for corresponding Chinese patent application No. 201710654174.3, dated Mar. 4, 2022, Chinese Patent Office.
First Office Action for for corresponding Chinese patent application No. 201710654174.3, dated Mar. 9, 2022, Chinese Patent Office.

* cited by examiner

MOBILE ROBOT

CROSS-REFERENCE TO RELATED APPLICATIONS

This application is a 371 U.S. national stage of PCT/CN2017/115640, filed Dec. 12, 2017, which claims the priority to Chinese Patent Application No. 201710654174.3, filed on Aug. 3, 2017, and the contents of each of which are incorporated by reference herein.

TECHNICAL FIELD

The present disclosure relates to the field of cleaning equipment, and particularly to a mobile robot.

BACKGROUND ART

A mobile robot is a device that intelligently controls movement to perform various tasks. The mobile robot, in particular a service robot, for example, a cleaning robot, and a mowing robot, is becoming increasingly common in everyday life. By way of example, the cleaning robot is a service robot for treating a surface to be cleaned (for example, floor, glass, etc.). Cleaning robots are increasingly used in everyday household life, especially in western countries. Every cleaning robot is provided with a container apparatus such as a garbage box, a liquid carrying tank or a sewage recovery tank. The garbage box is used to collect garbage when the floor is cleaned. The liquid carrying tank is used to contain water or disinfectant, and when the cleaning robot runs, water or liquid in the liquid carrying tank flows to the surface to be cleaned, such that stains on the surface to be cleaned are easier to be cleaned or facilitate disinfecting the surface to be cleaned. The sewage recovery tank is used to recover sewage on the surface to be cleaned.

The cleaning robot further includes a chassis, a cleaning brush for sweeping dirt into the container apparatus, and wheels, the cleaning brush thus being positioned adjacent to the container apparatus. In the prior art, two wheels are provided in the middle of the cleaning robot, and the container apparatus is located at a rear portion of the chassis, therefore, the cleaning brush is located between the two wheels, such that an extension length of the cleaning brush is limited, thus causing a too small working width of the cleaning robot.

SUMMARY

The technical problem to be solved by the present disclosure is to provide a mobile robot, which has a larger width of the cleaning brush than that in the prior art, thereby a working width of the mobile robot is increased.

In order to solve the above technical problem, an embodiment of the present disclosure adopts following technical solutions:

An embodiment of the present disclosure provides a mobile robot, wherein the mobile robot includes:

a robot housing;

two moving components, which are mounted to the robot housing, and configured to enable the mobile robot to move;

a container apparatus, mounted to the robot housing; and a cleaning component, comprising a main brush provided laterally relative to a direction in which the mobile robot moves forward normally, which is called as a normal forward direction, wherein the main brush is provided to be mounted to the robot housing, and located at or near a position of the robot housing, at which position a transverse width is largest, wherein the transverse width refers to a width defined by a direction perpendicular to the normal forward direction of the mobile robot;

an extension of the main brush in the direction perpendicular to the normal forward direction of the mobile robot is not interfered by the moving components.

In an embodiment, the container apparatus is provided between the two moving components.

In an embodiment, the robot housing includes a first side wall and a second side wall that are opposite with each other, the main brush has one end located at or close to the first side wall, and the other end located at or close to the second side wall, and the main brush is located in front of or behind the two moving components.

In an embodiment, the robot housing further includes a first housing wall and a second housing wall that are opposite with each other, the first side wall and the second side wall connect the first housing wall and the second housing wall, the first housing wall and the second housing wall are exposed to the outside environment, and the container apparatus passes through the first housing wall and the second housing wall of the robot housing.

In an embodiment, the container apparatus includes a top shell and a bottom shell that are opposite with each other, the top shell is flush with the first housing wall or the top shell protrudes from the first housing wall, and the top shell is a transparent body, such that a user can observe conditions inside the container apparatus through the top shell when the mobile robot is working.

In an embodiment, the container apparatus is a transparent body.

In an embodiment, an illuminating lamp or a color bar lamp is provided at a position of the first housing wall close to the container apparatus.

In an embodiment, each of the moving components includes a wheel, a transmission case and a motor, the wheel is located at one end of the transmission case, the motor is located at the other end of the transmission case, the wheel and the motor are located at the same side of the transmission case, and the wheel is close to a center line of the mobile robot perpendicular to the normal forward direction of the mobile robot.

In an embodiment, the container apparatus is a garbage box, the container apparatus has a first opening, the first opening is next to the cleaning component and is aligned with the cleaning component, and configured to collect garbage swept by the cleaning component; the mobile robot further includes a pressure reducing component, the pressure reducing component is adjacent to the container apparatus, the container apparatus can be ventilated with the pressure reducing component through a second opening, the pressure reducing component is configured to create a suction force so as to direct the garbage into the container apparatus, and a rotatable door assembly is provided at the second opening.

In an embodiment, the first housing wall or the container apparatus is provided with a locking mechanism, the locking mechanism includes a button, a first transmission arm, a second transmission arm, a first locking portion and a second locking portion, the first transmission arm has one end matched or connected with the button, and the other end matched or connected with the first locking portion, the second transmission arm has one end matched or connected with the button, and the other end matched or connected with the second locking portion, the first locking portion and the second locking portion are close to or embedded in the container apparatus, when the button is pressed or triggered, the locking mechanism can be in an open or closed state, when the locking mechanism is in a closed state, the first locking portion and the second locking portion lock the container apparatus, and when the locking mechanism is in an open state, the container apparatus is in an unlocked state.

Compared with the prior art, the technical solution of the present disclosure at least has following beneficial effects:

In the embodiments of the present disclosure, as the main brush of the cleaning component is provided to be mounted to the robot housing, and located at or near a position of the robot housing, at which position a transverse width is largest, and the extension of the main brush in the direction perpendicular to the normal forward direction of the mobile robot is not interfered by the moving components, the length of the main brush is increased, thereby increasing the working width of the mobile robot, and improving the working efficiency of the mobile robot.

BRIEF DESCRIPTION OF DRAWINGS

In order to more clearly illustrate technical solutions in the embodiments of the present disclosure or in the prior art, accompanying drawings which need to be used in the embodiments will be introduced briefly below. Apparently, the accompanying drawings in the following description are merely for some embodiments of the present disclosure. A person ordinarily skilled in the art still could obtain other alterations in light of these accompanying drawings, without using creative efforts.

DETAILED DESCRIPTION OF EMBODIMENTS

The technical solutions in the embodiments of the present disclosure will be described in detail below in conjunction with the accompanying drawings in the embodiments of the present disclosure, apparently, some but not all embodiments of the present disclosure are described. All other embodiments, obtained by those ordinarily skilled in the art based on the embodiments in the present disclosure without using creative efforts, shall fall into the scope of protection of the present disclosure.

Unless otherwise specified, orientation terms "front", "rear", "left", and "right" herein are all relative to a forward direction of a mobile robot during normal working, and the forward direction refers to a direction in which cleaning equipment advances. Wordings "up", "down", "bottom" or "top" all refer to a placement state of the cleaning equipment during normal working.

Figure 1A:
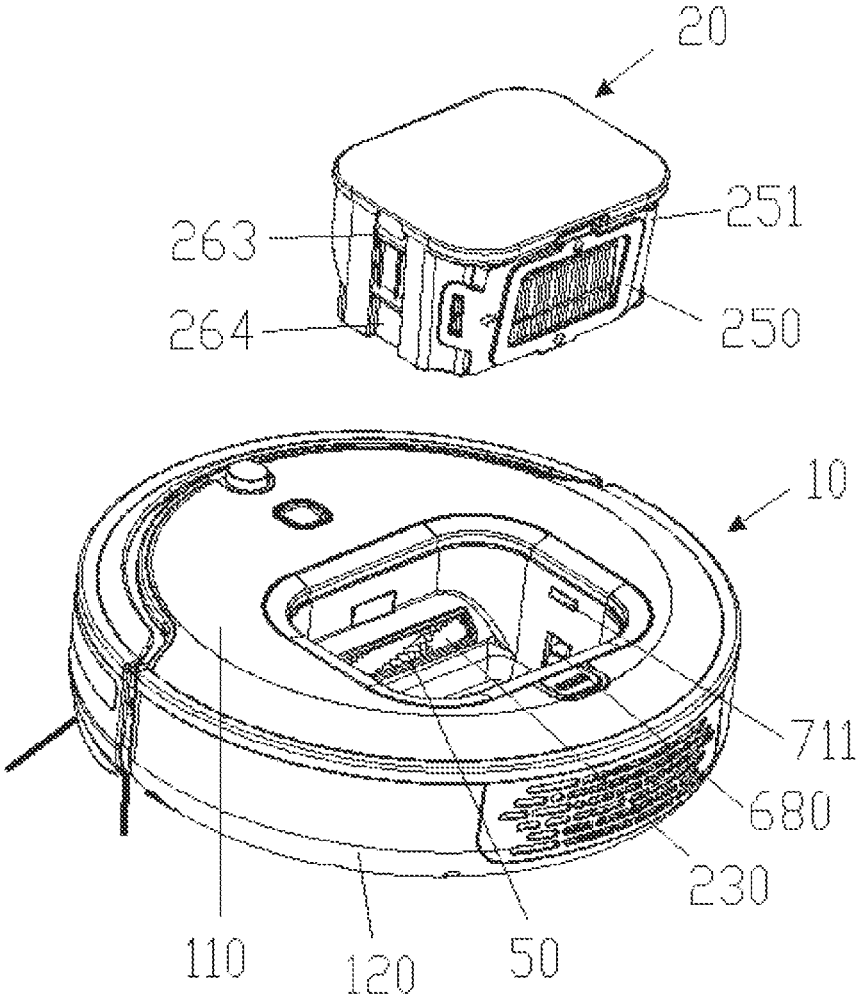
FIG. 1*a* is a structural schematic diagram showing that a robot housing is separated from a container apparatus in an embodiment of the present disclosure.
Figure 1B:
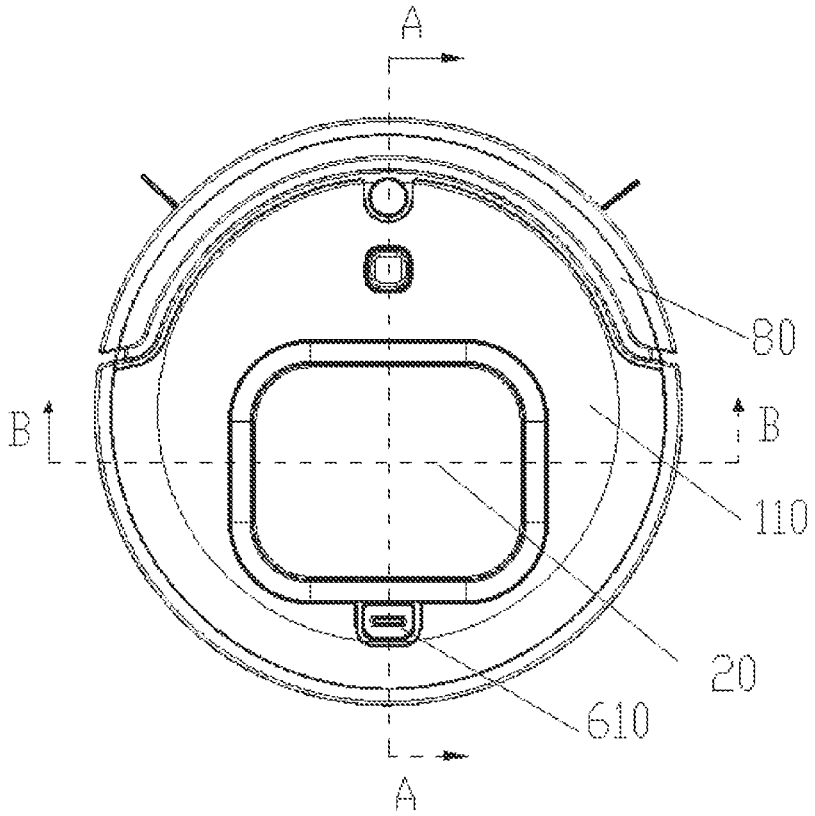
FIG. 1*b* is a top view of a mobile robot when normally placed in an embodiment of the present disclosure.
Figure 1C:
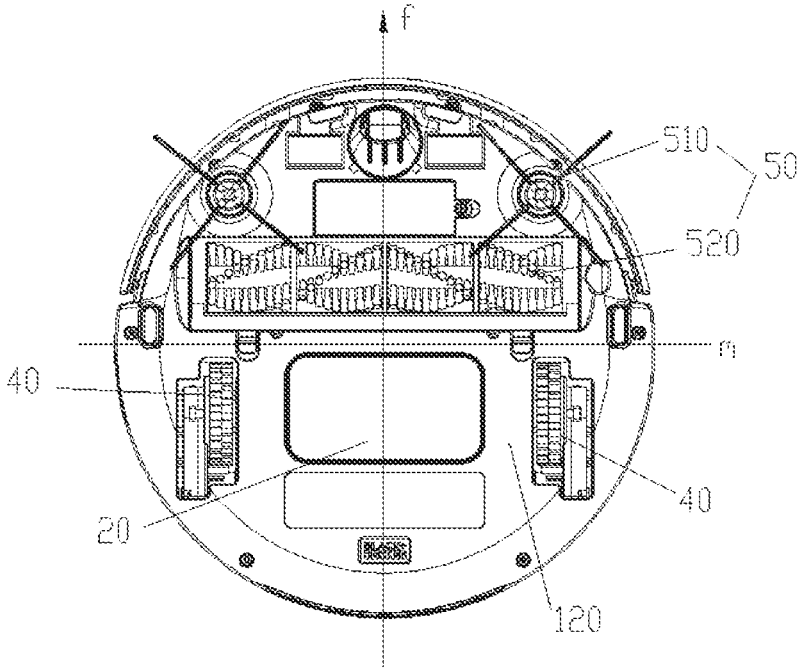
FIG. 1*c* is a bottom view of the mobile robot when normally placed in an embodiment of the present disclosure.
Figure 1D:
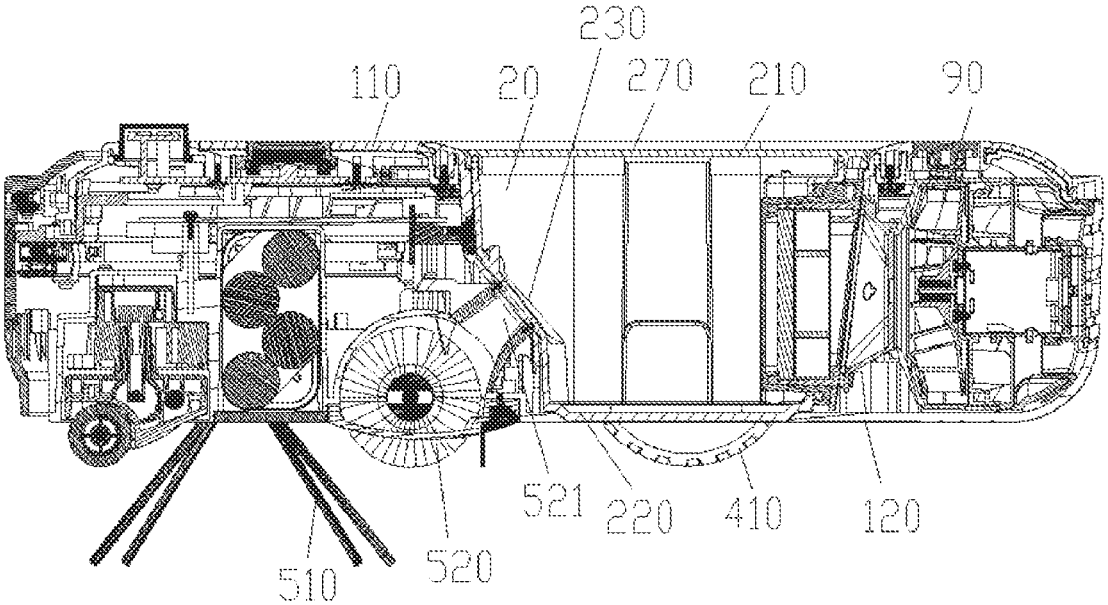
FIG. 1*d* is a sectional schematic diagram of the mobile robot along a section line A-A in FIG. 1*a* in an embodiment of the present disclosure.
Figure 1E:
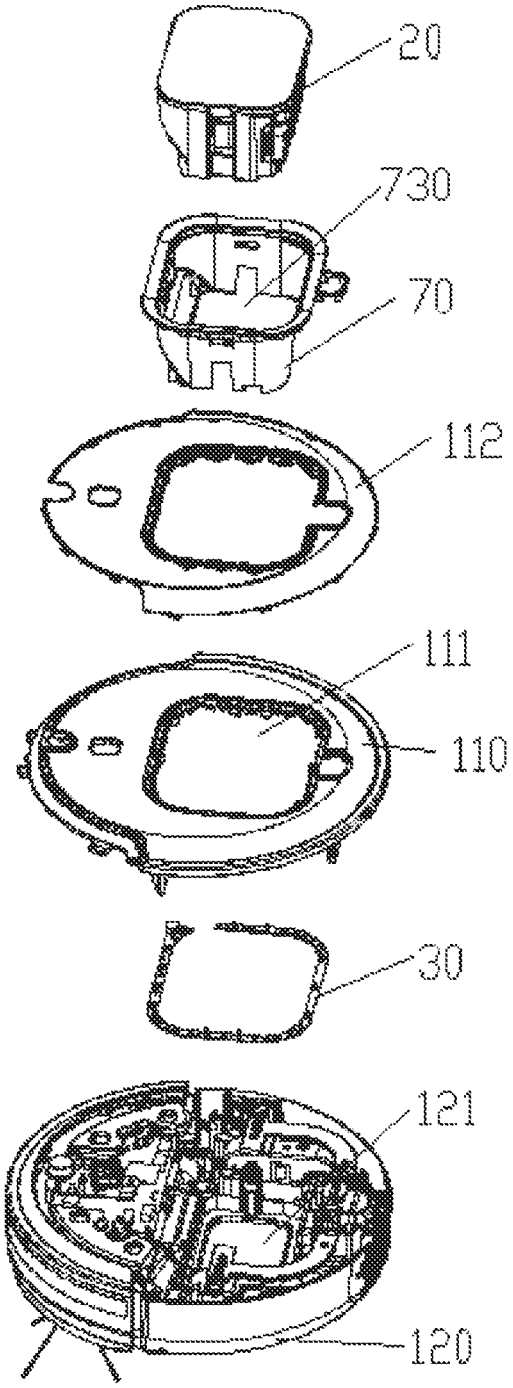
FIG. 1*e* is a schematic diagram of a split structure of the mobile robot in an embodiment of the present disclosure.

Please referring to FIGS. 1*a*, 1*b*, 1*c* and 1*d* together, FIG. 1*a* is a structural schematic diagram showing that a robot housing is separated from a container apparatus in an embodiment of the present disclosure; FIG. 1*b* is a top view of a mobile robot when normally placed in an embodiment of the present disclosure; FIG. 1*c* is a bottom view of the mobile robot when normally placed in an embodiment of the present disclosure; FIG. 1*d* is a sectional schematic diagram of the mobile robot along a section line A-A in FIG. 1*a* in an embodiment of the present disclosure; and FIG. 1*e* is a schematic diagram of a split structure of the mobile robot in an embodiment of the present disclosure. The mobile robot provided in an embodiment of the present disclosure includes a robot housing 10, a container apparatus 20 mounted to the housing, at least two moving components 40 and a cleaning component 50. The moving components 40 are mounted to the robot housing 10 and configured to enable the mobile robot to move. The cleaning component includes a main brush 520 provided laterally relative to a normal forward direction of the mobile robot. The main brush 520 is provided to be mounted to the robot housing 20, and located at or near a position of the robot housing 10, at which position a transverse width is largest. The transverse width refers to a width defined by a direction perpendicular to the normal forward direction of the mobile robot. Please referring to FIG. 1*c*, an arrow fin the figure indicates a forward direction of the mobile robot in a normal state, and an axis of the mobile robot corresponding to f is a forward direction axis. The transverse width refers to a width defined by a direction perpendicular to the forward direction axis f of the mobile robot, for example, the transverse width may be a length in an extending direction along a center line m.

In the above, extension of the main brush 520 in a direction perpendicular to the normal forward direction of the mobile robot is not interfered by the moving component, i.e., the width of the main brush 520 in the extending direction of the center line m is not interfered by the moving component 40.

In an embodiment, the container apparatus 20 is provided between two moving components 40.

The robot housing 10 may include a first side wall and a second side wall that are opposite with each other, the first side wall and the second side wall are respectively located at two sides of the forward direction axis f, the main brush 520 has one end close to the first side wall, and the other end close to the second side wall, that is, two ends of the main brush 520 may respectively pass through the first side wall and the second side wall, or two ends of the main brush 520 may be located at the first side wall and the second side wall, respectively, or two ends of the main brush 520 may be respectively located inside the mobile robot. It can be appreciated that the main brush 520 can be located in front of or behind the two moving components 40. In an embodiment, the first side wall and the second side wall may be integrally formed.

The robot housing 10 has a first housing wall 110 and a second housing wall 120 that are opposite with each other, and the first housing wall 110 and the second housing wall 120 are exposed to the outside environment, that is, the robot housing 10 substantially defines an outline of the mobile robot. The first side wall and the second side wall connect the first housing wall 110 and the second housing wall 120. When the mobile robot is in a normal working state, the first housing wall 110 is far away from a surface to be cleaned or a driving surface, and the second housing wall 120 is close to the surface to be cleaned or the driving surface. A receiving space is formed between the first housing wall 110 and the second housing wall 120, and configured to receive various mechanical parts and electronic parts. The mobile robot in the present embodiment is substantially in a circular shape, but this is merely an example, and in other embodiments, it further may be in a square shape, a triangular shape, a hexagonal shape, a shape similar with the Chinese character "人" or other shapes, or a combination of various shapes. In some embodiments, the robot housing 10 may further include a bumper 80, and the bumper 80 is located in a front portion of the mobile robot, configured to sense an obstacle encountered. The mobile robot further includes a control system, which is configured to control each part of the mobile robot, such that the mobile robot can finish tasks autonomously. The mobile robot further may include other obstacle detector, a positioning and navigating module, a charging device, a remote control device and other parts in the prior art, which are not described redundantly herein.

Figure 2A:
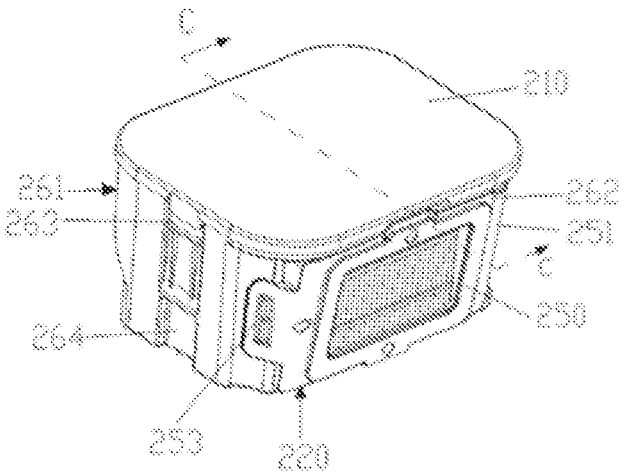
FIG. 2*a* is a schematic diagram of a three-dimensional structure of a container apparatus in an embodiment of the present disclosure.

The container apparatus 20 passes through the first housing wall 110 and the second housing wall 120 of the robot housing 10, that is, the container apparatus 20 is visible from the outside environment. The container apparatus 20 has a top shell 210 and a bottom shell 220 (please refer to FIG. 2*a*). Specifically, as can be seen from FIG. 1*e*, the first housing wall 110 has a first window 111, the second housing wall 120 has a second window 121, the top shell 210 of the container apparatus 20 is exposed from the first housing wall 110, and the bottom shell of the container apparatus 20 is exposed from the second housing wall 120. The top shell 210 is adjacent to the first housing wall 110, and the bottom shell 220 is adjacent to the second housing wall 120. In an embodiment, the top shell 210 of the container apparatus 20 is flush with the first housing wall 110. In another embodiment, the top shell 210 protrudes from the first housing wall 110 to extend outward. It should be understood that in an embodiment, the top shell 210 of the container apparatus 20 may be retracted a short distance toward inside of the mobile robot relative to the first housing wall 110. In an embodiment, the bottom shell 220 of the container apparatus 20 is flush with the second housing wall 120. In another embodiment, the bottom shell 220 protrudes from the second housing wall 120 to extend outward. Since the container apparatus 20 passes through the first housing wall 110 and the second housing wall 120 of the robot housing 10, the height of the container apparatus 20 may not be limited by the thickness of the first housing wall 110 and the second housing wall 120, thereby increasing the volume of the container apparatus 20, and when the container apparatus 20 is used to contain garbage and sewage, the user does not need to frequently dispose of the garbage because the container apparatus 20 is easily filled; when the container apparatus 20 is used to carry liquid wax, sanitizer, water or other cleaning fluids, there is no need to frequently add liquid wax, sanitizer, water or other cleaning fluids. Thus, the workload of the user is greatly reduced. In addition, when the top shell 210 of the container apparatus 20 is a transparent body or a translucent body, the user can observe the conditions inside the container apparatus 20 at any time without providing a garbage sensor or the like, which not only saves cost and reduces process difficulty, but also enables an observation result inside the container apparatus 20 to be intuitive and accurate.

In an embodiment, the mobile robot may further include an additional shell 112, which can be provided on an upper side or a lower side of the first housing wall 110, and can be used as a decoration layer or as an auxiliary of the first housing wall 110.

It should be appreciated that in an embodiment, the bottom shell 220 of the container apparatus 20 may be retracted a short distance toward inside of the mobile robot relative to the second housing wall 120, as desired or preferred.

Specifically, the top shell 210 of the container apparatus 20 is a transparent body, such that the user can observe the conditions inside the container apparatus 20 through the top shell 210 while the mobile robot is working. In other embodiments, the container apparatus 20 is transparent as a whole, allowing for a clear view of the conditions inside the container apparatus 20 without opening the container apparatus 20. The container apparatus 20 may be one or a combination of more of a garbage box, a liquid carrying tank, and a sewage recovery tank, for example, it may be a garbage box, and also may be a combination of a garbage box and a liquid carrying tank. Of course, the container apparatus 20 may also be used to contain or collect other substances desired by a customer. In an embodiment, the container apparatus 20 is a garbage box for containing garbage. The garbage includes dust, debris, dirt and other waste products thrown away by the user. Further, when reference is made herein to particles, the particles include, but are not limited to, dust, debris, dirt and other waste products.

Further, a lamp assembly 30 is provided at a position of the first housing wall 110 close to the container apparatus 20, and the lamp assembly 30 may be an illuminating lamp or a color bar lamp packaged on a circuit board. In an embodiment, the lamp assembly 30 is provided along an edge of the first window 111 of the first housing wall 110, and circles around the first window 111. In an embodiment, the lamp assembly 30 may also be provided on the container apparatus 20. The lamp assembly 30 further may be provided at other parts of the first housing wall 110 where the container apparatus 20 can be illuminated. The lamp assembly 30 can illuminate the container apparatus 20 at night, such that the user can see the conditions inside the container apparatus 20 in the dark, for example, can see whether the container apparatus is full of garbage, so that the user can dispose of the garbage at the right time, therefore, no sensor related to garbage detection needs to be provided on the mobile robot, reducing the cost. A sensor used for detecting the garbage in the prior art can be wrong sometimes, and a detection result may be inaccurate, but such mistake can be avoided with the container apparatus in the embodiment of the present disclosure. It can be understood that in the present embodiment, the lamp assembly 30 can be used for decoration, allowing the mobile robot to be capable of displaying the position of the mobile robot when working at night, and increasing the aesthetic feeling.

In an embodiment, the mobile robot further includes a cleaning component 50 and two moving components 40, the cleaning component 50 is located in front of the two moving components 40, and located in front of the container apparatus 20. A width of the cleaning component 50 spanning the robot housing 10 is greater than a distance between the two moving components 40, that is, the width of the cleaning component 50 spanning the robot housing 10 is greater than a width of the two moving components 40 spanning the robot housing 10. By spanning, it means being perpendicular to an extending direction of a forward direction of the mobile robot during normal working. The cleaning component 50 includes a first cleaning sub-component 510 and a main brush 520. The first cleaning sub-component 510 is provided in at least one, and preferably, the first cleaning sub-component 510 is provided in two, respectively located at two sides of the robot housing 10 (with reference to the forward direction). The first cleaning sub-component 510 rotates about an axis that is not parallel to the surface to be cleaned (e.g., rotating about an axis that is perpendicular to the surface to be cleaned) so as to agitate dirt (garbage) on the surface to be cleaned (e.g., the floor).

Spanning the robot housing 10, the main brush 520 rotates about an axis parallel to the surface to be cleaned, so as to sweep garbage agitated by the first cleaning sub-component 510 into the container apparatus 20. The main brush 520 may further include two rollable brushes that rotate relative to each other.

The mobile robot further includes a pressure reducing component 90, and the pressure reducing component 90 is adjacent to the container apparatus 20, and can be in airflow communication with the container apparatus 20. In an embodiment, the pressure reducing component 90 is provided rearward of the container apparatus 20. The pressure reducing component 90 is configured to create a pressure that is smaller than that in the outside environment, in a space inside the mobile robot and in communication with the pressure reducing component, for example, the pressure reducing component 90 is a blower or other vacuum assembly. When the pressure reducing component 90 is activated, the container apparatus 20 has a smaller air pressure or becomes vacuumized, and an air pressure in the space where the cleaning component 50 is located also becomes smaller therewith, such that the airflow from the outside (for example, the surface to be cleaned) rushes toward the cleaning component 50, so that the garbage on the surface to be cleaned is subjected to a suction force toward the container apparatus 20, consequently, the garbage on the surface to be cleaned and the garbage on the cleaning component 50 are sucked into the container apparatus 20.

Figure 2B:
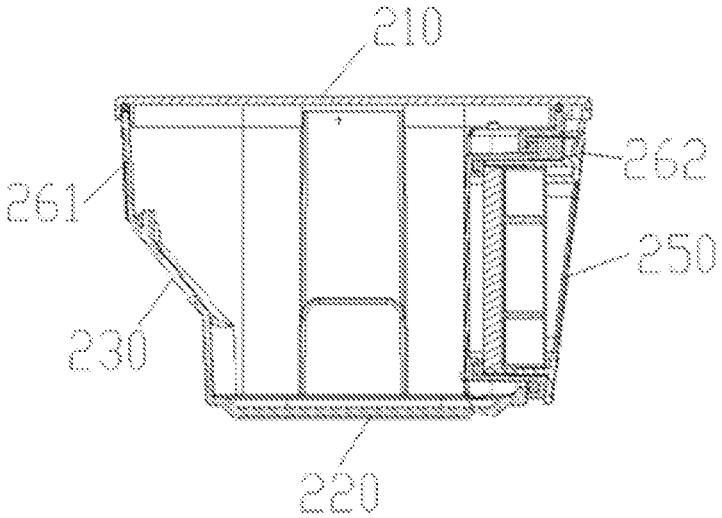
FIG. 2*b* is a side view of the container apparatus in an embodiment of the present disclosure.
Figure 3A:
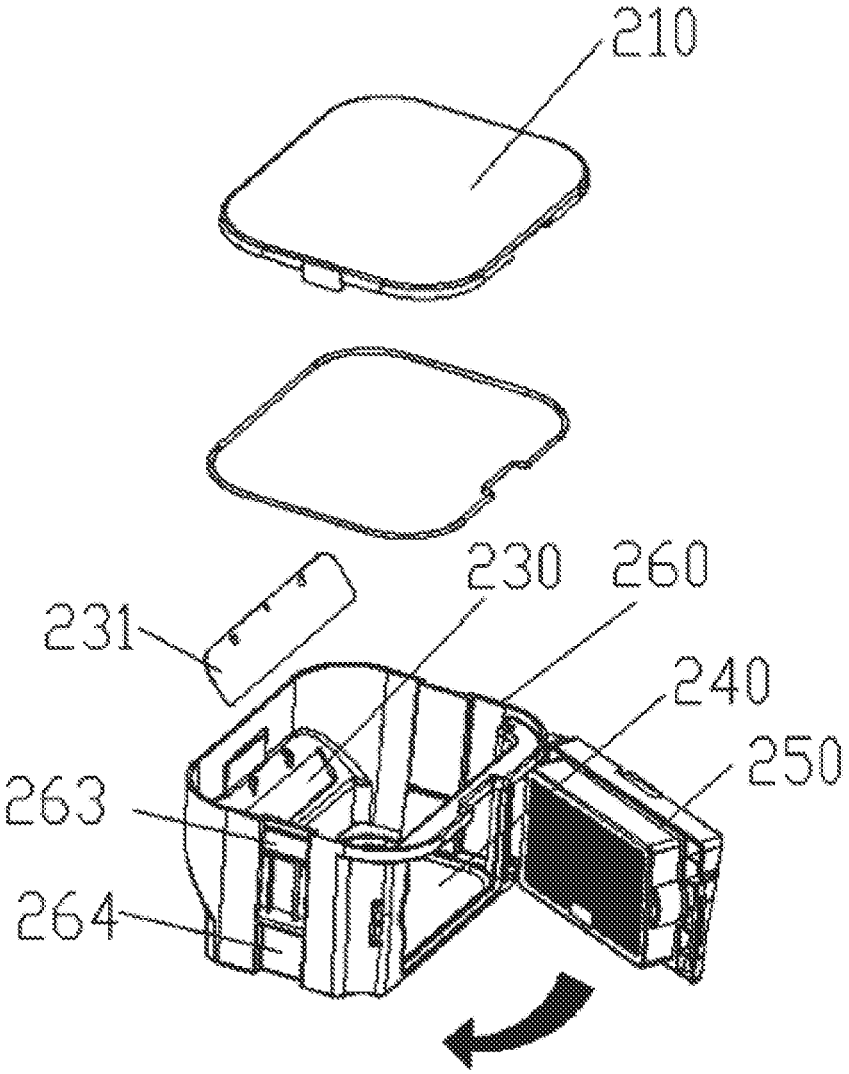
FIGS. 3*a* and 3*b* are schematic diagrams of a split structure of the container apparatus in an embodiment of the present disclosure.
Figure 3B:
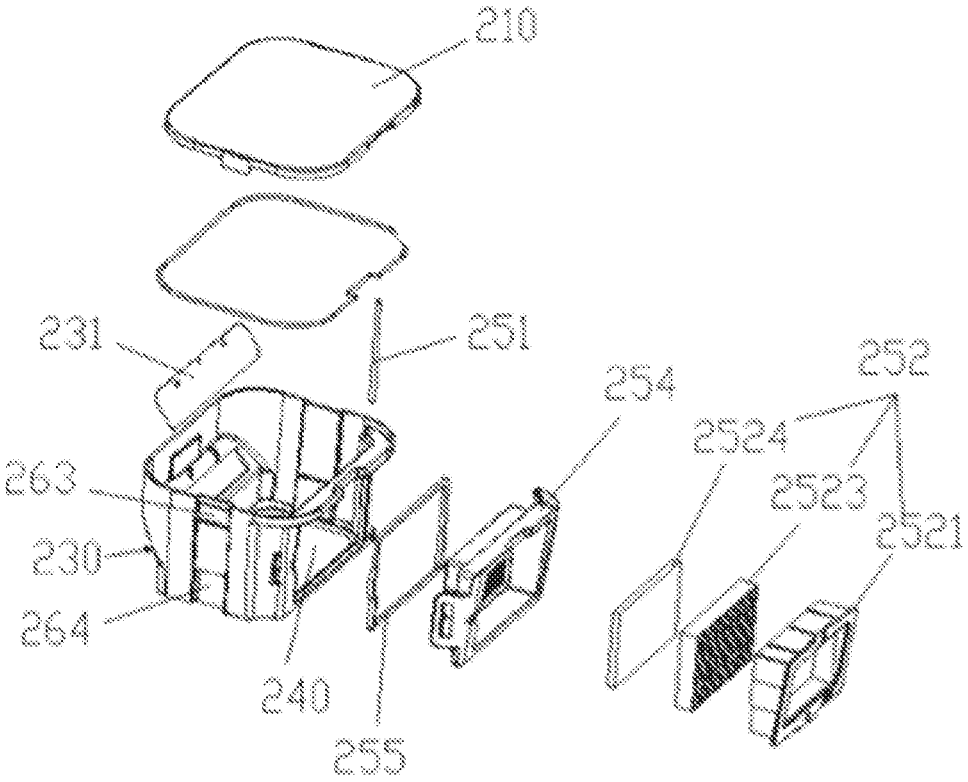

Specifically, please referring to FIG. 2*a*, FIG. 2*b*, FIG. 3*a* and FIG. 3*b*, FIG. 2*a* is a schematic diagram of a three-dimensional structure of the container apparatus in an embodiment of the present disclosure; FIG. 2*b* is a side view of the container apparatus in an embodiment of the present disclosure; and FIGS. 3*a* and 3*b* are schematic diagrams of a split structure of the container apparatus in an embodiment of the present disclosure.

The container apparatus 20 includes a top shell 210, a bottom shell 220 and a side wall 260. The top shell 210 and the bottom shell 220 are oppositely disposed, and the side wall 260 connects the top shell 210 and the bottom shell 220. In an embodiment, the side wall 260 is provided with a first opening 230 and a second opening 240. The first opening 230 is adjacent to the cleaning component 50, and is aligned with the main brush 520. In an embodiment, the airflow in the space where the main brush 520 is located is directed by a guide channel 521 to the first opening 230. Mowed grass or garbage swept by the first cleaning sub-component 510 and the main brush 520 toward the mobile robot enters the container apparatus 20 through the first opening 230. The container apparatus 20 is ventilated with the pressure reducing component 90 through the second opening 240, and the pressure reducing component 90 is configured to create a suction force so as to enable the garbage or grass to enter the container apparatus 20. A rotatable door assembly 250 is provided at the second opening 240.

The door assembly is rotatable about a shaft 251. The shaft 251 is provided at a portion of an edge of the second opening 240, and in an embodiment, the shaft 251 is provided on the side wall 260. The door assembly 250 rotates about the shaft 251 to be opened or closed, the door assembly 250 meshes with the second opening 240 when closed, forming a barrier against particles (garbage), and when the door assembly 250 is opened, contents of the container apparatus 20, such as garbage, particularly dust, can be released from the container apparatus 20. As the door assembly 250 is provided at the side wall, when the container apparatus is cleaned, the contents such as garbage in the container apparatus 20 can be poured out just by opening the door assembly 250, and slightly tilting the container apparatus 20 toward the side of the door assembly 250, moreover, the user can conveniently clean out the contents from the second opening 240, without turning the bottom upward as in the prior art.

In an embodiment, the door assembly 250 is provided between the container apparatus 20 and the pressure reducing component 90, the door assembly 250 includes a filter mechanism 252, and the filter mechanism 252 is configured to filter particles and other solid matters (e.g., solid wastes), i.e., the filter mechanism 252 allows airflow or liquid to pass through, but does not allow particles or other solid matters to pass through.

The door assembly 250 further includes a nesting rack 254, and the filter mechanism 252 is embedded in the nesting rack 254. The filter mechanism 252 includes an embedded frame 2521 and a filter element 2523, the filter element 2523 is provided in the embedded frame 2521, the embedded frame 2521 is embedded in the nesting rack 254, and the nesting rack 254 is rotatably connected to the shaft 251. The filter element 2523 may be a filter screen, filter foam, or other existing filter articles that may have a filtering function. The filter mechanism 252 further may include an auxiliary filter element 2524, which may or may not be the same as the filter element 2523. Specifically, one side of the nesting rack 254 is provided with a pit, a wall of which is provided with a plurality of through holes, and the filter mechanism 252 is placed in the pit.

The door assembly 250 further may include a first sealing frame 255, and the first sealing frame 255 is provided between the nesting rack 254 and a container side wall 260 of the container apparatus 20; the filter mechanism 252 further may include a second sealing frame (not shown in the drawings), which is provided between an edge of the nesting rack 254 and an edge of the filter mechanism 252; the filter mechanism 252 further may include a third sealing frame (not shown in the drawings), which is provided between an edge of the filter element 2523 and the embedded frame 2521.

In an embodiment, the door assembly 250 further may include a door lock 253 for locking or releasing the door assembly 250.

In an embodiment, the side wall 260 includes a first container side wall 261 and a second container side wall 262 that are opposite with each other, the first opening 230 is provided in the first container side wall 261, and the first opening 230 may be smaller than the first container side wall 261, and the second opening 240 is provided in the second container side wall 262. The first opening 230 has a smaller width in a direction perpendicular to the first housing wall 110 than the first container side wall 261. In an embodiment, the width of the first opening 230 in the direction perpendicular to the first housing wall 110 is in a range of one-fourth to one-half of the width of the first container side wall 261 in the direction perpendicular to the first housing wall 110.

Figure 4A:
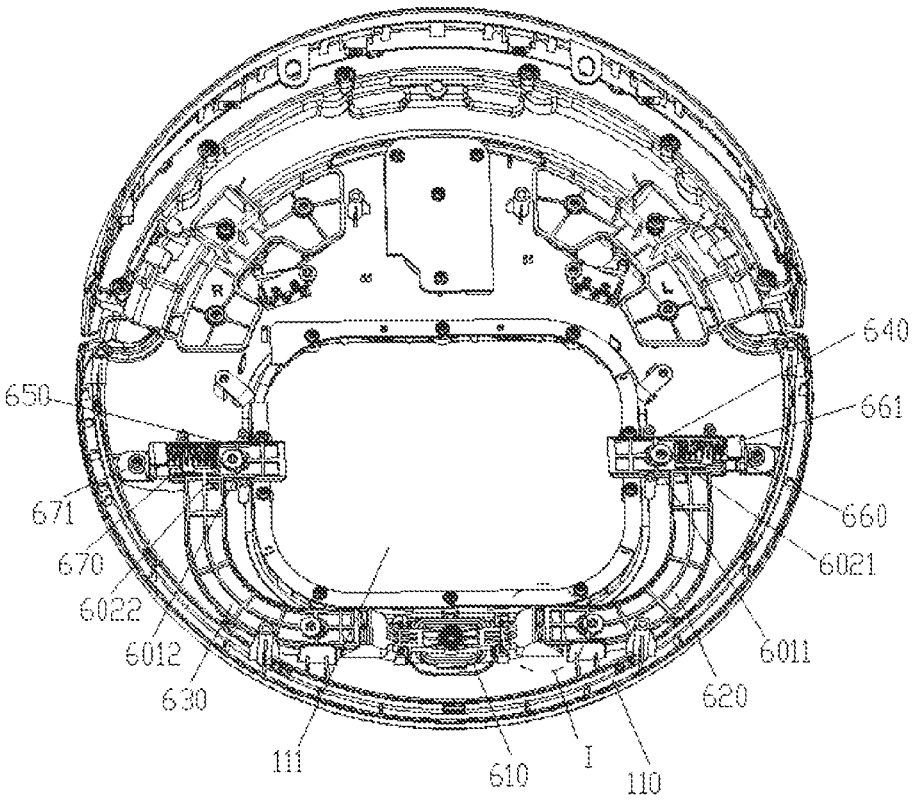
FIG. 4*a* is a structural schematic diagram of an inner structure of a first housing wall of the mobile robot and a locking mechanism for locking the container apparatus in an embodiment of the present disclosure.
Figure 4B:
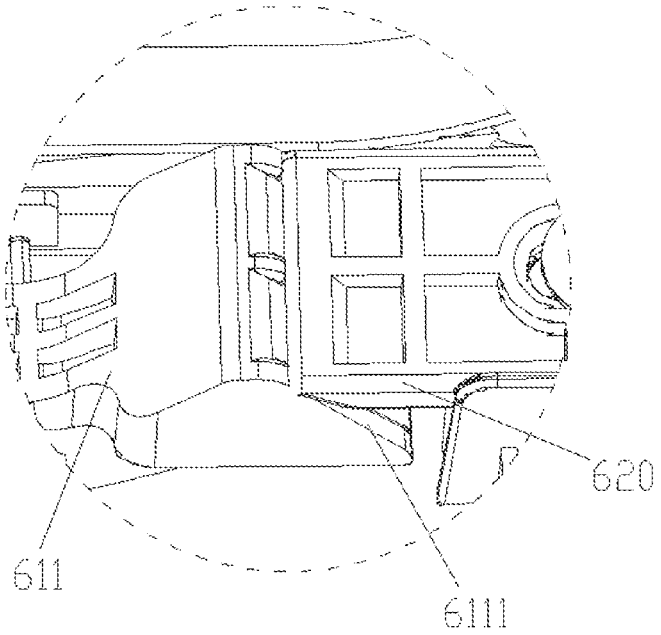
FIG. 4*b* is a partial enlarged view of portion I in FIG. 4*a;*
Figure 4C:
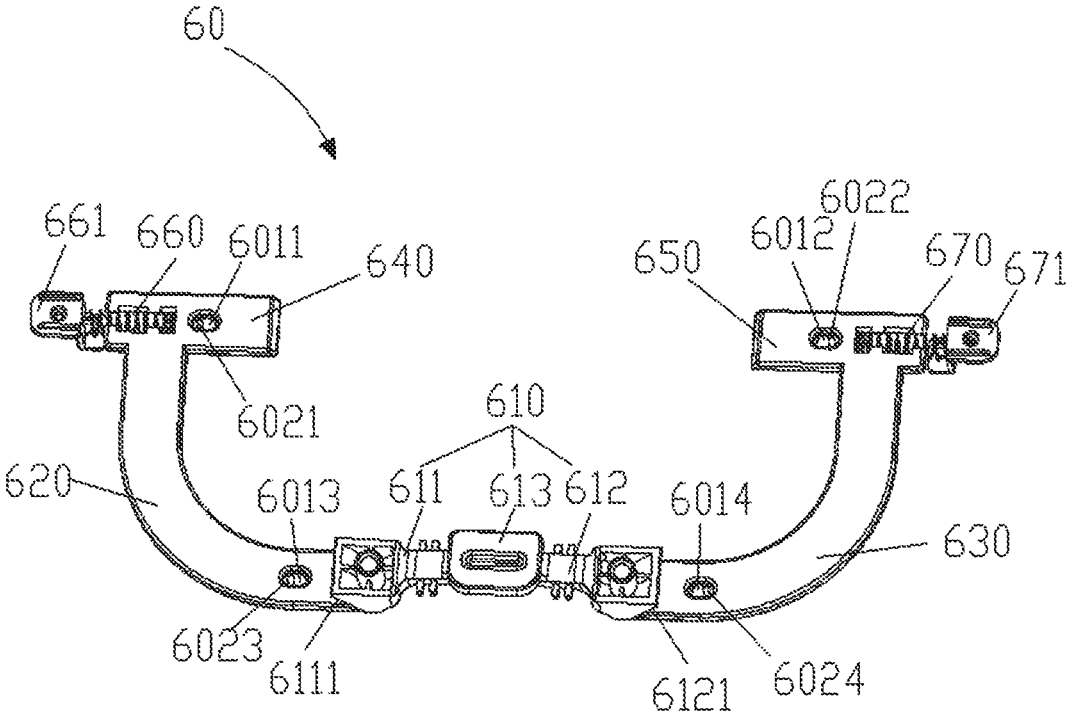
FIG. 4*c* is a structural schematic diagram of the locking mechanism in an embodiment of the present disclosure.
Figure 4D:
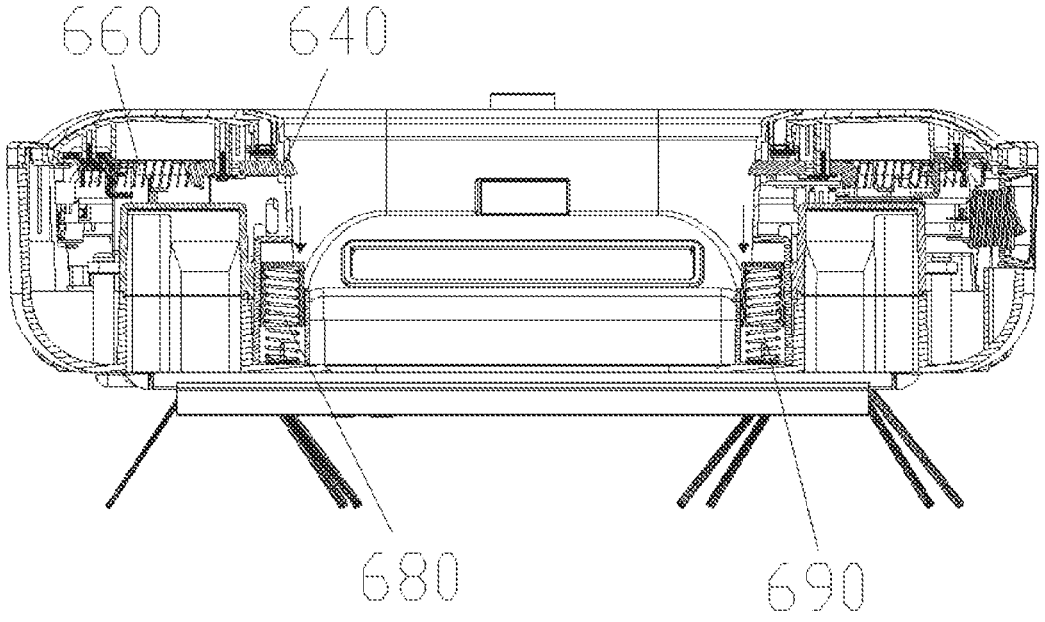
FIG. 4*d* is a sectional schematic diagram of the mobile robot along a section line B-B in FIG. 1*a* in an embodiment of the present disclosure.

Pleasing referring to FIG. 4*a*, FIG. 4*b*, FIG. 4*c* and FIG. 4*d*, FIG. 4*a* is a structural schematic diagram of an inner structure of the first housing wall of the mobile robot and a locking mechanism for locking the container apparatus in an embodiment of the present disclosure; FIG. 4*b* is a partial enlarged view of portion I in FIG. 4*a*; FIG. 4*c* is a structural schematic diagram of the locking mechanism in an embodiment of the present disclosure; and FIG. 4*d* is a sectional schematic diagram of the mobile robot along a section line B-B in FIG. 1*a* in an embodiment of the present disclosure. In an embodiment of the present disclosure, the first housing wall 110 is provided with a locking mechanism 60, and the locking mechanism 60 is configured to lock or eject the container apparatus 20 on or from the main body of the mobile robot. The locking mechanism 60 can be provided on the robot housing 10, or can be provided on the container apparatus 20.

In an embodiment, the locking mechanism 60 includes a button 610, a first transmission arm 620, a second transmission arm 630, a first locking portion 640 and a second locking portion 650, wherein the first transmission arm 620 has one end matched or connected with the button 610, and the other end matched or connected with the first locking portion 640, and the second transmission arm 630 has one end matched or connected with the button 610, and the other end matched or connected with the second locking portion 650. The first locking portion 640 and the second locking portion 650 are adjacent to the container apparatus 20. Preferably, the first locking portion 640 and the second locking portion 650 are located at two opposite sides of the container apparatus 20, respectively. The first locking portion 640 and the second locking portion 650 hold the container apparatus 20. When the button 610 is pressed or moved or toggled, the locking mechanism 60 can be in an open or closed state. When the locking mechanism 60 is in a closed state, the first locking portion 620 and the second locking portion 630 lock the container apparatus 20, and when the locking mechanism 60 is in an open state, the container apparatus 20 is in an unlocked state.

In an embodiment, the button 610 may include a button main body 613, a first extension portion 611 and a second extension portion 612, and the first extension portion 611 and the second extension portion 612 are respectively located at two sides of the button main body 613. The first extension portion 611 contacts the first transmission arm 620, the second extension portion 612 contacts the second transmission arm 630, the first transmission arm 620 and the first locking portion 640 may be integrally formed, and the second transmission arm 630 and the second locking portion 650 may be integrally formed. It can be understood that in another embodiment, the first transmission arm 620 may contact the first locking portion 640 in a transmission form, and the second transmission arm 630 may contact the second locking portion 650 in a transmission form. When the button 610 is pressed down or activated, the first extension portion 611 of the button 610 drives the first transmission arm 620, the second extension portion 612 drives the second transmission arm 630, the first transmission arm 620 drives the first locking portion 640 to enable it to be away from the container apparatus 20, and the second transmission arm 630 drives the second locking portion 650 to be away from the container apparatus 20, thereby releasing the container apparatus 20, and putting the container apparatus 20 in an unlocked state.

In an embodiment, an end of the first extension portion 611 away from the button main body 613 is made into a slope 6111, and an end of the second extension portion 612 away from the button main body 613 is made into a slope 6121. The slope 6111 is abutted with an end of the first transmission arm 620 away from the first locking portion 640, and the slope 6121 is abutted with an end of the second transmission arm 630 away from the second locking portion 650. The side wall 260 of the container apparatus 20 is provided with first recesses 263 corresponding to the first locking portion 640 and the second locking portion 650, respectively, and when the locking mechanism 60 is in a locking state, the first locking portion 640 and the second locking portion 650 are clamped at corresponding first recesses 263, respectively. The side wall 260 or a bottom portion of the container apparatus 20 further may be provided with at least two second recesses 264, and elastic members, e.g., elastic members 680 and 690 (FIG. 4*d*), for ejecting the container apparatus 20 after the container apparatus 20 is released, are mounted on the second housing wall 120 corresponding to the at least two second recesses 264, respectively.

Inclined surfaces of the slopes 6111 and 6121 may face the side facing away from the first housing wall 110, and when the button 610 is pressed down, the slopes 6111 and 6121 move downward (toward the inside of the robot), and the slope 6111 abuts against the first transmission arm 620, so that the first transmission arm 620 moves outward (in a direction away from the button 610), thereby pushing the first locking portion 640 outward, the slope 6121 abuts against the second transmission arm 630, so that the second transmission arm 630 moves outward (in a direction away from the button 610), thereby pushing the second locking portion 650 outward, so as to move the first locking portion 640 and the second locking portion 650 away from respective first recesses 263, respectively, thereby releasing the container apparatus 20. Subsequently, the elastic members 680 and 690 respectively bounce the container apparatus 20 through respective second recesses 264, so that the container apparatus 20 protrudes a certain distance from an outer surface of the first housing wall 110, facilitating the user in taking out the container apparatus 20 for cleaning.

Further, an elastic member 660 is provided at an end of the first locking portion 640 away from the container apparatus 20, the elastic member 660 is mounted on the first housing wall 110 through an elastic member seat 661 (it can be understood that the elastic member also may be mounted on another component that can be fixed), an end of the second locking portion 650 away from the container apparatus 20 is provided with an elastic member 670, and the elastic member 670 is mounted on the first housing wall 110 through an elastic member seat 671 (it can be understood that the elastic member also may be mounted on another fixed component). When the user has cleaned the container apparatus 20, and wants to mount the container apparatus 20 to a main body of the mobile robot, the user directly puts the container apparatus 20 into a receiving space formed at least partially on the basis of the first window 111 and the second window 121, and presses the container apparatus downward (toward the inside of the mobile robot), and when the first locking portion 640 and the second locking portion 650 are aligned with the first recesses 263, respectively, the elastic member 660 and the elastic member 670 are reset, respectively, so as to push the first locking portion 640 and the second locking portion 650 into the two first recesses 263, respectively, thereby locking the container apparatus 20. The locking mechanism 60 greatly simplifies the difficulty for the user to mount and remove the container apparatus, making it easier for the user.

In an embodiment, the first housing wall 110 is mounted with a retaining shell 70 configured to retain the container apparatus 20, the retaining shell 70 forms a hollow window 730 that fits the container apparatus 20 in shape, and the container apparatus 20 can be placed in the hollow window 730. The retaining shell 70 is provided with through holes 711 at positions corresponding to the first locking portion 640 and the second locking portion 650, respectively, and when the first locking portion 640 and the second locking portion 650 lock the container apparatus, the first locking portion 640 and the second locking portion 650 pass through the through holes 711, respectively, to contact the container apparatus 20.

In an embodiment, the locking mechanism 60 can define a movable range of the locking mechanism through cooperation of the through holes and a retaining rod. For example, please referring to FIGS. 4*a* and 4*c*, a movable range of the first transmission arm 620 is defined by a through hole 6013 provided in the first transmission arm 620 and a retaining rod 6023 passing through the through hole 6013; a movable range of the second transmission arm 630 is defined by a through hole 6014 provided in the second transmission arm 630 and a retaining rod 6024 passing through a through hole 6014; a movable range of the first locking portion 640 is defined by a through hole 6011 provided in the first locking portion 640 and a retaining rod 6021 passing through the through hole 6011; a movable range of the second locking portion 650 is defined by a through hole 6012 provided in the second locking portion 650 and a retaining rod 6022 passing through the through hole 6012.

Figure 5:
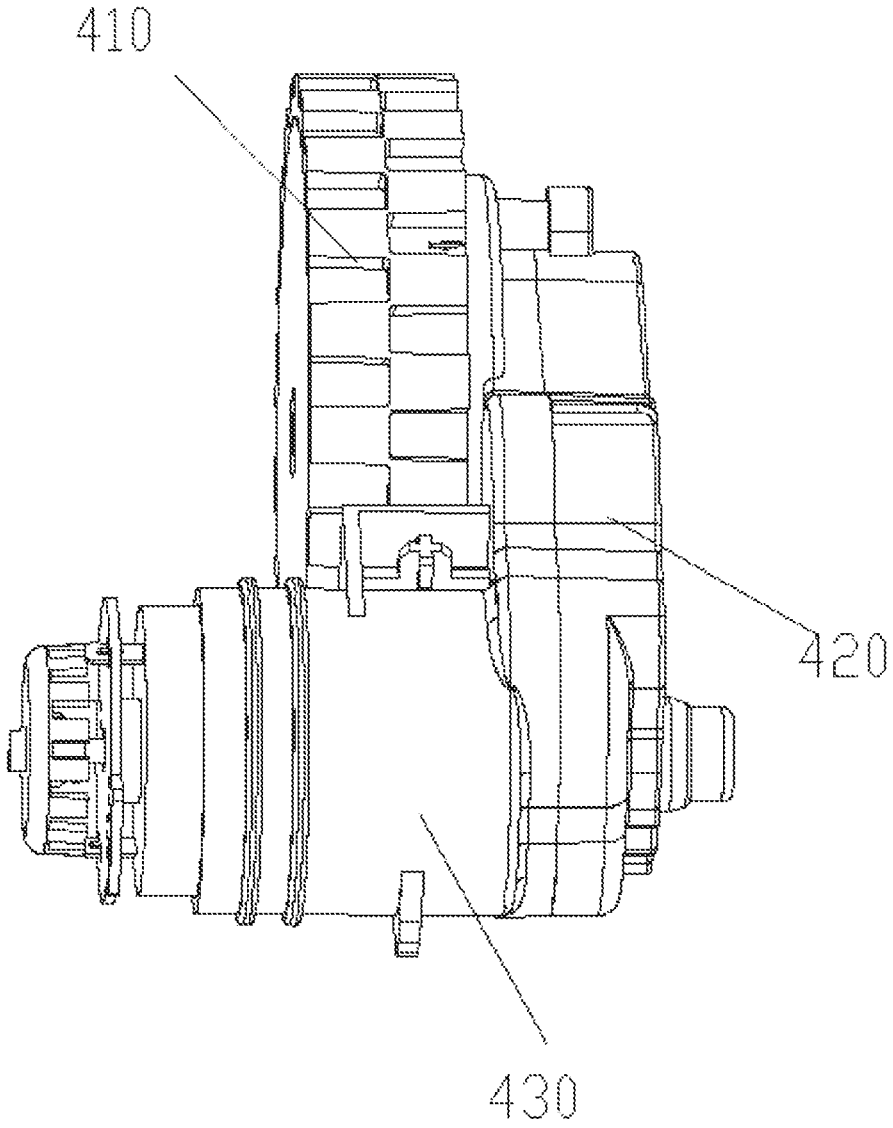
FIG. 5 is a structural schematic diagram of a moving component of the mobile robot in an embodiment of the present disclosure.

Please referring to FIG. 1*c* and FIG. 5, FIG. 1*c* is a bottom view of the mobile robot when normally placed in an embodiment of the present disclosure, and FIG. 5 is a structural schematic diagram of the moving component of the mobile robot in an embodiment of the present disclosure. The mobile robot further includes at least two moving components 40, the moving components 40 can be mounted to the housing 10, preferably to the second housing wall 120, and the container apparatus 20 can be located between the two moving components 40. The main brush 520 is located in front of the moving components 40 and the container apparatus 20, and the main brush 520 is located at or near the center line m of the mobile robot perpendicular to the forward direction.

In an embodiment, each moving component 40 includes a wheel 410, a transmission case 420 and a motor 430. The wheel 410 is provided at one end of the transmission case 420, the motor 430 is located at the other end of the transmission case 420, and the motor 430 provides power to the wheel 410 through the transmission case 420, such that the wheel 410 can rotate. The wheel 410 and the motor 430 are located at the same side of the transmission case 420, for example, the wheel 410 and the motor 430 are located at a side of the transmission case 420 facing the container apparatus 20. The wheel 410 is provided to be adjacent to the center line m of the mobile robot perpendicular to the forward direction, and the transmission case 420 and the motor 430 are provided to be away from the center line m perpendicular to the forward direction. In an embodiment in which the mobile robot is circular, the center line m is located on a straight line where a diameter of the mobile robot perpendicular to the forward direction is located. In this way, the wheel 410, while serving as a moving part, can be used as a load-bearing part to be as close as possible to a middle position of the mobile robot, which is more conducive to the movement and stability of the mobile robot; besides, by providing the moving components 40 in this way, the main brush 520 can be allowed to be closer to the center line m, such that the main brush 520 has a longer length in the direction of the center line m, thus increasing the working width of the mobile robot, and improving the cleaning efficiency of the mobile robot as a cleaning robot.

In the description of the present description, description with reference to terms "an embodiment", "some embodiments", "example", "specific example" or "some examples" and so on means that the specific features, structures, materials or characteristics described in connection with this embodiment or example are contained in at least one embodiment or example of the present disclosure. In the present description, exemplary expressions of the above terms do not necessarily refer to the same embodiment or example. Moreover, the specific features, structures, materials or characteristics described can be combined in a suitable manner in any one or more embodiments or examples.

The embodiments described above do not constitute limitation on the scope of protection of the technical solution. Any amendments, equivalent replacements, improvements and so on made within the spirit and principle of the above embodiments, should be covered within the scope of protection of the technical solution.

What is claimed is:

1. A mobile robot, wherein the mobile robot comprises:
- a robot housing;
- two moving components, which are mounted to the robot housing, and configured to enable the mobile robot to move;
- a container apparatus, which is mounted to the robot housing;
- a cleaning component, comprising a main brush provided laterally relative to a direction in which the mobile robot moves forward normally, which is called as a normal forward direction; and
- an additional shell,
- wherein
- the robot housing comprises:
  - a first housing wall; and
  - a second housing wall,
  - wherein,
  - the first housing wall and the second housing wall are opposite from each other;
  - a first side wall and a second side wall connect the first housing wall and the second housing wall;
  - the first housing wall and the second housing wall are at least partially exposed to outside environment; and
- the container apparatus passes through the first housing wall and the second housing wall of the robot housing;
- the main brush is provided to be mounted to the robot housing, and located at or near a position of the robot housing, at which position a transverse width is largest, wherein the transverse width refers to a width defined by a direction perpendicular to the normal forward direction of the mobile robot;

an extension of the main brush in the direction perpendicular to the normal forward direction of the mobile robot is not interfered by the moving components; and the additional shell is provided on an upper side or a lower side of the first housing wall, and is able to be used as a decoration layer or as an auxiliary layer of the first housing wall.

2. The mobile robot according to claim 1, wherein the container apparatus is provided between the two moving components.

3. The mobile robot according to claim 1, wherein the robot housing comprises the first side wall and the second side wall that are opposite with each other, the main brush has one end located at or close to the first side wall, and the other end located at or close to the second side wall, and the main brush is located in front of or behind the two moving components.

4. The mobile robot according to claim 1, wherein the container apparatus comprises a top shell and a bottom shell that are opposite with each other, the top shell is flush with the first housing wall or the top shell protrudes from the first housing wall, and at least the top shell of the container apparatus is a transparent body, such that a user is able to observe conditions inside the container apparatus through the top shell when the mobile robot is working.

5. The mobile robot according to claim 1, wherein the container apparatus comprises a top shell and a bottom shell that are opposite with each other, and the bottom shell is retracted a certain distance toward inside of the mobile robot relative to the second housing wall.

6. The mobile robot according to claim 1, wherein the container apparatus is a transparent body.

7. The mobile robot according to claim 1, wherein an illuminating lamp or a color bar lamp is provided at a position of the first housing wall close to the container apparatus.

8. The mobile robot according to claim 7, wherein the illuminating lamp or the color bar lamp is provided along an edge of a first window of the first housing wall.

9. The mobile robot according to claim 1, wherein each of the moving components comprises a wheel, a transmission case and a motor, wherein the wheel is located at one end of the transmission case, the motor is located at the other end of the transmission case, the wheel and the motor are located at a same side of the transmission case, and the wheel is close to a center line of the mobile robot perpendicular to the normal forward direction of the mobile robot.

10. The mobile robot according to claim 1, wherein the container apparatus is a garbage box, the container apparatus has a first opening, the first opening is adjacent to the cleaning component and is aligned with the cleaning component, which is configured to collect garbage swept by the cleaning component; and the mobile robot further comprises a pressure reducing component, the pressure reducing component is adjacent to the container apparatus, the container apparatus is ventilated with the pressure reducing component through a second opening, the pressure reducing component is configured to create a suction force so as to enable the garbage to enter the container apparatus, and a rotatable door assembly is provided at the second opening.

11. The mobile robot according to claim 1, wherein the first housing wall or the container apparatus is provided with a locking mechanism, wherein the locking mechanism comprises a button, a first transmission arm, a second transmission arm, a first locking portion and a second locking portion, the first transmission arm has one end matched or connected with the button, and the other end matched or connected with the first locking portion, the second transmission arm has one end matched or connected with the button, and the other end matched or connected with the second locking portion, the first locking portion and the second locking portion are close to or embedded in the container apparatus, wherein when the button is pressed or triggered, the locking mechanism is made to be in an open or closed state; when the locking mechanism is in a closed state, the first locking portion and the second locking portion lock the container apparatus; and when the locking mechanism is in an open state, the container apparatus is in an unlocked state.

12. The mobile robot according to claim 1, wherein the container apparatus comprises a top shell, a bottom shell and a side wall of the container apparatus, wherein the top shell and the bottom shell are oppositely disposed, the side wall connects the top shell and the bottom shell, the side wall is provided with a first opening and a second opening, the first opening is adjacent to the cleaning component, and the second opening is provided with a door assembly rotatable around a shaft.

13. A mobile robot, wherein the mobile robot comprises:

a robot housing, having a first housing wall and a second housing wall that are opposite with each other, wherein the first housing wall and the second housing wall are exposed to outside environment; and a container apparatus, passing through the first housing wall and the second housing wall of the robot housing.

14. The mobile robot according to claim 13, wherein the container apparatus comprises a top shell and a bottom shell that are opposite with each other, wherein the top shell is flush with the first housing wall or the top shell protrudes from the first housing wall, and the top shell is a transparent body, such that a user is able to observe conditions inside the container apparatus through the top shell when the mobile robot is working.

15. The mobile robot according to claim 13, wherein the first housing wall and the second housing wall are provided in such a manner that when the mobile robot is working normally, the first housing wall is far away from a surface to be cleaned, and the second housing wall is close to the surface to be cleaned; and the container apparatus comprises a top shell and a bottom shell that are opposite with each other, the top shell is close to the first housing wall, and the bottom shell is flush with the second housing wall or the bottom shell is close to the second housing wall.

* * * * *